US009246241B2

(12) United States Patent
Yamamoto et al.

(10) Patent No.: US 9,246,241 B2
(45) Date of Patent: Jan. 26, 2016

(54) CRIMPING STRUCTURE

(71) Applicant: Yazaki Corporation, Tokyo (JP)

(72) Inventors: Masataka Yamamoto, Makinohara (JP); Mitsuji Kubota, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/514,894

(22) Filed: Oct. 15, 2014

(65) Prior Publication Data

US 2015/0111438 A1 Apr. 23, 2015

(30) Foreign Application Priority Data

Oct. 23, 2013 (JP) ..... 2013-220452

(51) Int. Cl.

| | |
|---|---|
| ***H01R 4/24*** | (2006.01) |
| ***H01R 4/18*** | (2006.01) |
| ***H01R 13/405*** | (2006.01) |
| ***H01R 43/16*** | (2006.01) |
| *H01R 13/11* | (2006.01) |
| *H01R 43/24* | (2006.01) |

(52) U.S. Cl.

CPC ..... *H01R 4/2416* (2013.01); *H01R 4/18* (2013.01); *H01R 4/2433* (2013.01); *H01R 4/2437* (2013.01); *H01R 4/2441* (2013.01); *H01R 13/405* (2013.01); *H01R 43/16* (2013.01); *H01R 13/112* (2013.01); *H01R 43/24* (2013.01)

(58) Field of Classification Search

CPC ..... H01R 4/2416

See application file for complete search history.

(56) References Cited

U.S. PATENT DOCUMENTS

| | | | | | |
|---|---|---|---|---|---|
| 4,073,560 | A * | 2/1978 | Anhalt | H01R 4/2458 | 439/400 |
| 4,160,574 | A * | 7/1979 | DeRoss | H01R 4/2416 | 439/405 |
| 4,861,278 | A * | 8/1989 | McBride et al. | | 439/395 |
| 4,872,849 | A * | 10/1989 | Long | | 439/209 |
| 5,009,618 | A | 4/1991 | Black et al. | | |
| 5,890,924 | A | 4/1999 | Endo et al. | | |
| 6,264,496 | B1 * | 7/2001 | Robertson et al. | | 439/409 |
| 6,328,592 | B1 * | 12/2001 | Burke et al. | | 439/417 |
| 6,866,536 | B1 * | 3/2005 | Lee | | 439/395 |
| 2006/0030199 | A1 * | 2/2006 | Chung Long Shan | | 439/404 |

(Continued)

FOREIGN PATENT DOCUMENTS

| | | |
|---|---|---|
| JP | 4-74869 U | 6/1992 |
| JP | 2001-143776 A | 5/2001 |

(Continued)

OTHER PUBLICATIONS

Search Report dated Nov. 24, 2014 issued by the European Patent Office in counterpart European Patent Application No. 14188505.3.

*Primary Examiner* — James Harvey
(74) *Attorney, Agent, or Firm* — Sughrue Mion, PLLC

(57) ABSTRACT

A crimping structure includes a crimping terminal that has a base plate and a crimping blade part on the base plate, a coated electric wire that has a conductor which is electrically connected to the crimping blade part by crimping the coated electric wire to the crimping blade, and is bend to be formed into a mountain-like shape whose top part is a connecting part where the conductor and the crimping blade part are connected, and an insulative resin part that covers a part of the coated electric wire from the top part to hem parts at two sides of the mountain-like shape and the crimping blade part.

16 Claims, 11 Drawing Sheets

(56) References Cited

U.S. PATENT DOCUMENTS

| | | | | |
|---|---|---|---|---|
| 2009/0101407 | A1* | 4/2009 | Yamamoto | 174/72 A |
| 2009/0321131 | A1* | 12/2009 | Yamamoto | 174/72 A |
| 2011/0117794 | A1* | 5/2011 | Landis et al. | 439/730 |
| 2015/0111438 | A1* | 4/2015 | Yamamoto et al. | 439/741 |

FOREIGN PATENT DOCUMENTS

| | | | |
|---|---|---|---|
| JP | 2010-260297 | A | 11/2010 |
| JP | 2012-30429 | A | 2/2012 |
| JP | 2013-103492 | A | 5/2013 |

* cited by examiner

RELATED ART

CRIMPING STRUCTURE

CROSS REFERENCE TO RELATED APPLICATION

This application is based on Japanese Patent Applications No. 2013-220452 filed on Oct. 23, 2013, the contents of which are incorporated herein by reference.

BACKGROUND OF THE INVENTION

1. Technical Field

The present invention relates to a crimping structure.

2. Background Art

A waterproof crimping structure is known to conductively connect electric wires of a wire harness (for example, refer to a JP-UM-A-4-74869).

As shown in FIG. 11, the waterproof crimping structure, includes a crimping terminal 505 which has a crimping slot 503 to which an electric wire 501 is electrically connected by being press-fitted so that the coating is broken and the conductor is crimped, a connector body 509 which holds the crimping terminal 505 by accommodating the crimping terminal 505 with a terminal holder 507, and a cover body 511 which is installed to the connector body 509 so that the crimping terminal 505 is covered.

The fringe part of the connector body 509 is formed with a filler base part 515 into which waterproof filler 513 is filled to surround the crimping terminal 505 and the terminal holder 507. A waterproof projecting frame 517, whose upper part and side parts are closed and whose lower part is opened, is protruded from the bottom of the cover body 511. The top surface of the fringe part of the connector body 509 is formed to be lower than a crimping point 519 of the crimping terminal 505. The waterproof projecting frame 517 enters the waterproof filler 513, which is filled in the filler base part 515, when the cover body 511 is installed, and submerges by making the electric wire 501 to be bent into a U shape (strain reliefs 521 are formed).

Further, a crimping joint terminal sealing structure is proposed (for example, refer to a JP-A-2001-143776) for which a crimping joint terminal is sealed inside an insulative molding body together with coated electric wires which are crimped to crimping terminal parts so that while a waterproofing function and an insulating function are implemented, resistance against a pulling load of the coated electric wires (strain relief) is improved.

However, for the traditional waterproof crimping connector shown in FIG. 11, an operation of closing the connector body 509 and the cover body 511 for the purpose of crimping and a troublesome operation of making the electric wire 501 to be bent into a U shape at both sides of the crimping point 519 by making the waterproofing projecting frame 517 enter the filler base part 515 where the waterproof filler 513 is filled for the purpose of strain relief are necessary, and the manufacturing cost increases.

For the crimping joint terminal sealing structure for which the crimping terminal parts are sealed by the insulative molding body, in order to form the strain relief, it is necessary to integrate with the insulative molding body while the coated electric wire is bent downward, and is bent into a crank shape, the metal die is complicated, and the manufacturing cost increases.

The present invention is made in view of the above situations, and the object of the present invention is to provide a cheap crimping structure so that strain relief can be formed with a simple structure.

SUMMARY OF THE INVENTION

The above object of the present invention is achieved with the following constructions.

(1) According to an aspect of the invention, a crimping structure includes a crimping terminal that has a base plate and a crimping blade part on the base plate, a coated electric wire that has a conductor which is electrically connected to the crimping blade part by crimping the coated electric wire to the crimping blade, and is bend to be formed into a mountain-like shape whose top part is a connecting part where the conductor and the crimping blade part are connected, and an insulative resin part that covers a part of the coated electric wire from the top part to hem parts at two sides of the mountain-like shape and the crimping blade part.

According to the crimping structure of the construction of the above (1), the coated electric wire is crimped to the crimping blade part of the crimping terminal. Thus, the coated electric wire, which is bent into a mountain-like shape whose top part corresponds to the connecting part of the conductor and the crimping blade part, is covered by the insulative resin part, from the top part until the hem parts at two sides. An external force which acts on the two ends of the coated electric wire which is derived from the insulative resin part is born by the insulative resin part at the hem parts at two sides, and does not act on the connecting part. That is, at two sides of the connecting part of the conductor and the crimping blade part, strain reliefs can be easily constructed. When the coated electric wire, which is bent into a mountain-like shape, is crimped, pulling loads obliquely downward respectively toward the hem parts at two sides act on the conductor at the connecting part (with the crimping blade part) which corresponds to the top part of the coated electric wire, so that it can be expected that the conductor is prevented from scattering. Further, it is possible to perform the crimping operation and to cover coated electric wire with the insulative resin part at the same time.

(2) In the crimping structure of (1), the insulative resin part is integrally molded.

According to the crimping structure of the construction of the above (2), the coated electric wire, whose top part corresponds to the connecting part, is fixed by being molded integrally with insulative resin material until the hem parts at two sides. An external force which acts on the two ends of the coated electric wire which is derived from the insulative resin part is more surely born by the insulative resin part, which is integrally molded, at the hem parts at two sides, and does not act on the connecting part. Further, the connecting part is waterproofed when the insulative resin material is molded integrally.

(3) In the crimping structure of (2), the crimping blade part is a protruded piece protruded from one side part of the base plate.

According to the crimping structure of the construction of the above (3), the crimping blade part is protruded from one side part of the crimping blade part. Thereby, in comparison with the crimping blade part whose slit is directly cut at the one side part, because the connecting part is away from the base plate, the slit is easy to be surrounded by the insulative resin material, and it is possible to mold surely.

According to the crimping structure of the present invention, strain reliefs can be constructed with a simple structure.

The present invention has been briefly described above. Further, details of the present invention will become more apparent after embodiments of the invention described below (hereinafter referred to as "embodiments") are read with reference to the accompanying Figures.

DESCRIPTION OF EMBODIMENTS

Below, embodiments of the present invention are described with reference to the figures.

Figure 1:
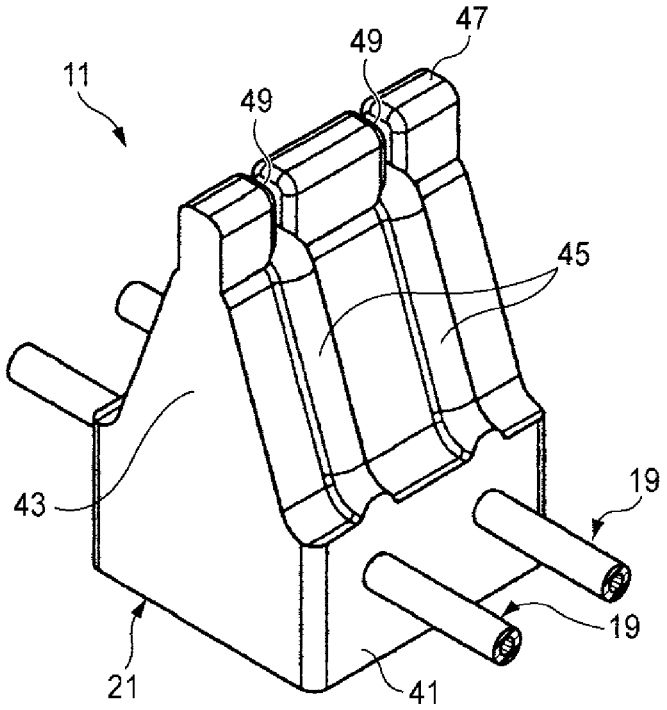
FIG. 1 is an overall perspective view of a crimping structure according to a first embodiment of the present invention.
Figure 2A:
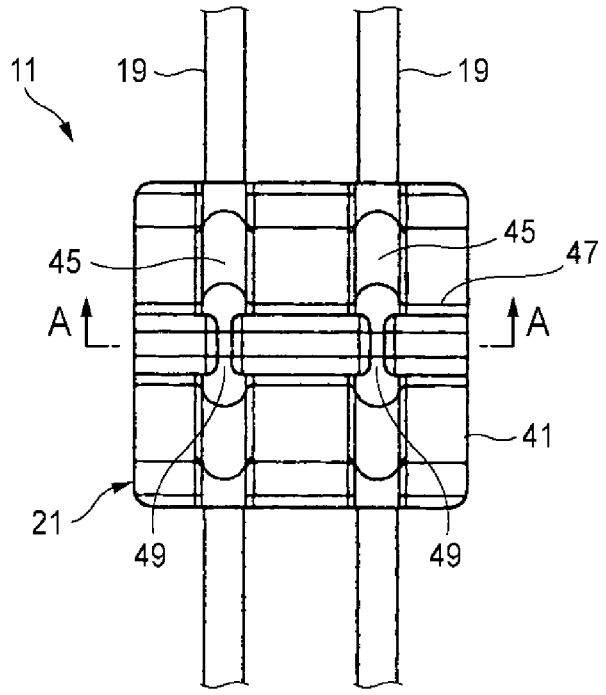
FIGS. 2A and 2B are a top view and a side view of the crimping structure shown in FIG. 1.
Figure 2B:
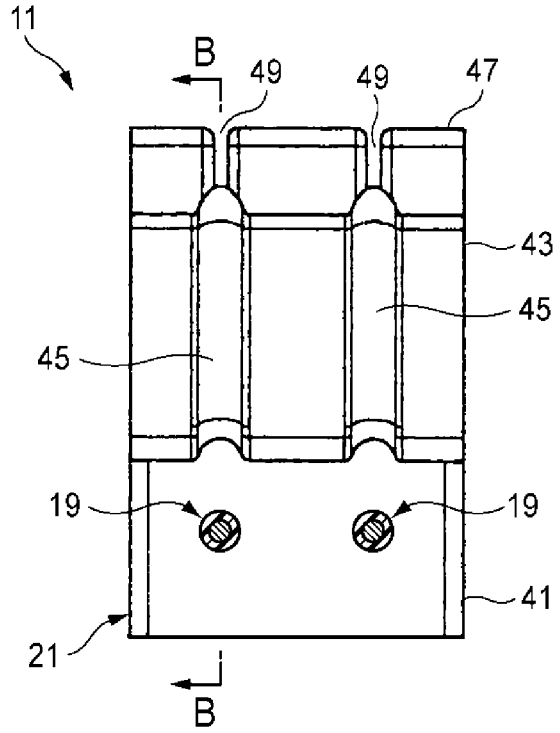

As shown in FIGS. 1 to 3, a crimping structure 11 according to the first embodiment of the present invention is an electric wire joint structure which mainly includes a crimping terminal 13 which has a base plate 15 and crimping blade parts 17, coated electric wires 19, and a mold housing (insulative resin part) 21.

The crimping terminal 13 has the base plate 15 which is flat and made of conductive metal. The crimping structure 11 has fundamental functions of fixing a plurality of coated electric wires 19 and electrically connecting the plurality of coated electric wires 19 with the base plate 15. The base plate 15 has a straight one side part 23, and is formed into a polygonal shape. In this embodiment, the base plate 15 is formed into a rectangular shape the horizontal sides of which are longer than the vertical sides. The longer upper side of the base plate 15 becomes the one side part 23. The longer lower side, which is the other side part 57 of the base plate 15 and is opposite to the one side part 23, is provided with a pair of position regulating projecting pieces 25. The position regulating projecting pieces 25 are to position the crimping terminal 13 while the crimping terminal 13 is held by a terminal holding part of a molding die during the molding of the mold housing 21. That is, for example, the lower die of the molding die (not shown) for molding the mold housing 21 is formed with a recess as a terminal holding part in which the position regulating projecting pieces 25 are fitted.

A plurality of (two in the embodiment) crimping blade parts 17 are formed along the extending direction of the one side part 23 of the base plate 15. Two inner sides, which face each other, of a U-shaped slit 27 of the crimping blade part 17 become blade parts 29. In this embodiment, each crimping blade part 17 becomes a protruded piece 31 and is protruded from the one side part 23. The coated electric wires 19 are pressed into the slits 27, which are cut from above, of the crimping blade parts 17, respectively. The opening ends of the slits 27 are formed with guiding surfaces 33 to guide the coated electric wires 19 into the slits 27 easily. The width of the slits 27 is slightly smaller than the conductor outer diameter of the coated electric wires 19. Therefore, coatings 35 of the coated electric wires 19, which are pressed into the slits 27, are cut and conductors 37 contact the blade parts 29 so as the coated electric wires 19 are electrically connected (crimped) to the crimping blade parts 17. Thus, the two coated electric wires 19, which are crimped to the two crimping blade parts 17, are conductively connected through the base plate 15.

As described below, the crimping terminal of the crimping structure of the present invention may include three or more crimping blade parts 17, and the crimping structure of the present invention may include two or more crimping terminals in the mold housing 21 which is an insulative resin part. The width of the slits 27 of the crimping blade parts 17 may vary according to the coated electric wires 19 to be crimped.

When the two coated electric wires 19 are pressed into the slits 27 of the crimping blade parts 17 respectively, as described above, the coatings 35 are cut and the conductors 37 are electrically connected to the blade parts 29 and are mutually conducted. In this embodiment, the conductors 37 of the coated electric wires 19 are formed by twisting a plurality of strands. In addition, the coated electric wires 19 also may have a single-thread conductor.

Figure 3B:
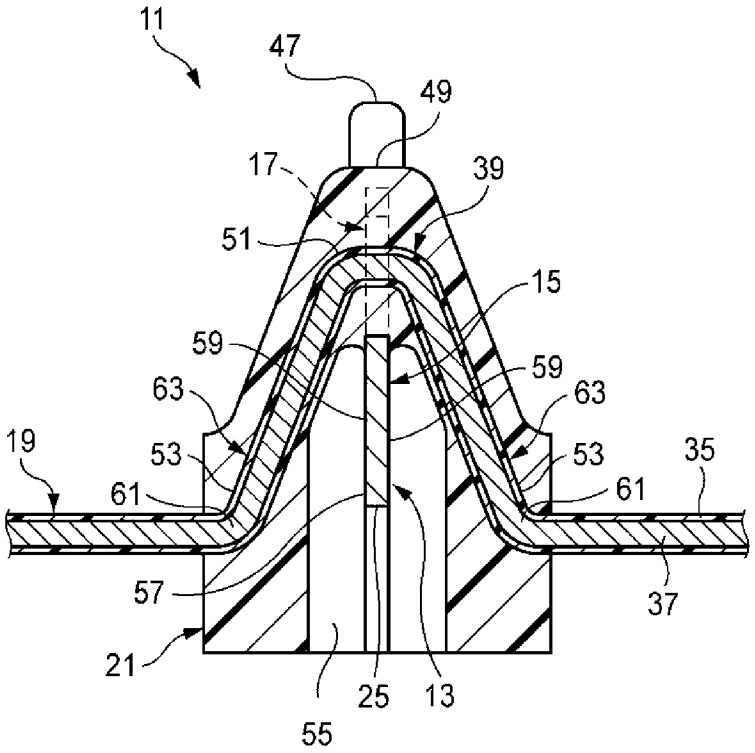
FIG. 3B is a B-B sectional view of FIG. 2B.
Figure 3A:
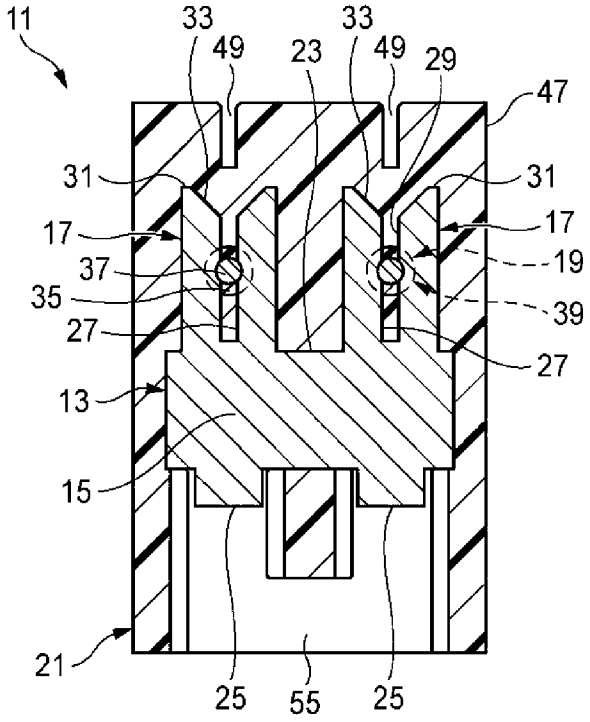
FIG. 3A is an A-A sectional view of FIG. 2A.

The mold housing 21 is an insulative resin part which is formed by molding insulative resin material with a molding die. That is, the mold housing 21 includes connecting parts 39 where the conductors 37 and the crimping blade parts 17 are connected, and is integrally molded to coat the crimping blade parts 17 and the coated electric wires 19 around the connecting parts 39. In the first embodiment, as shown in FIG. 1, the mold housing 21 has such an external shape that a substantially triangular prism-formed peak part 43 is integrally formed on the top of a base body 41 which has a flat rectangular parallelepiped shape. As shown in FIG. 3A, the two coated electric wires 19, which are bent into a mountain-like shape, are incorporated in the peak part 43 in parallel along the central axis of the triangular prism.

Ribs 45 are bulged along the incorporated position of the coated electric wires 19 from a pair of slopes of the mountain-like peak part 43. A rising wall 47 is provided adjacently to the upper end of the peak part 43 along the central axis of the triangular prism. The rising wall 47 is formed with a pair of cut recesses 49. The ribs 45 are formed from one slope of the mountain-like part to the other slope of the mountain-like part through the bottom of the cut recesses 49.

Inside the mold housing 21, the coated electric wires 19 are bent into a mountain-like shape whose top parts 51 correspond to the connecting parts 39. As shown in FIG. 3B, the mold housing 21 molds the coated electric wires 19 from the top parts 51 to hem parts 53 at both sides which sandwich the top parts 51.

In the mold housing 21, a terminal clamping space 55 is concavely provided to expose base plate front and back surfaces 59 at the other side part 57 of the base plate 15.

When the mold housing 21 is molded, a molding die (not shown in the figure), which, for example, includes an upper die and a lower die, and a micromolding machine (not shown), which injects molten resin to the cavity of the molding die, are used. The micromolding machine is such a machine that the quantity of resin which can be molded by one injection is up to around dozens of g, and includes a mold clamping device (not shown) for which, when the molding die is to be clamped, the clamping can be performed manually using an air cylinder or a link, and a low pressure discharger (not shown) which pressurizes and injects molten resin to the molding die. More specifically, well-known "injection molding devices" disclosed in, for example, JP-A-2010-260297, JP-A-2012-30429 and JP-A-2013-103492 can be used as the micromolding machine.

Nylon, polyolefin, polypropylene or the like can be used as the thermoplastic insulative resin material to mold the mold housing 21. The thermoplastic insulative resin material is heated and softened by using the low pressure discharger and is injected into the cavity in an injectable flow state. When a predetermined quantity of the thermoplastic insulative resin material is supplied, the cavity is full of the thermoplastic insulative resin material.

When the thermoplastic insulative resin material is heated, polymerization is caused and a polymer network structure is formed, and the thermoplastic insulative resin material will not return to the original shape by curing. Thereby, the crimping terminal 13 and the coated electric wires 19 are fixed to the mold housing 21 at a predetermined strength.

Then, the effect of the crimping structure 11 having the above construction is described.

According to the crimping structure 11 of the first embodiment, when the two coated electric wires 19 are crimped respectively by being pushed into the slits 27 of the two crimping blade parts 17 of the crimping terminal 13, the coatings 35 of the two coated electric wires 19 at both sides are cut, and the conductors 37 are connected to the blade parts 29 electrically. These parts become the connecting parts 39 where the crimping blade parts 17 and the coated electric wires 19 are connected. The two coated electric wires 19, which are connected to the base plate 15 through the connecting parts 39, are mutually connected through the base plate 15. The connecting parts 39 and the crimping blade parts 17 and the coated electric wires 19 around the connecting parts 39 are fixed by being integrally molded with the mold housing 21.

The molding die for molding the mold housing 21 is formed, for example, of a lower die and an upper die. The lower die is formed with a terminal holding part which holds the crimping terminal 13. The other side part 57 of the base plate 15 of the crimping terminal 13 is held in the terminal holding part. On the other hand, the upper die is formed with a pair of electric wire holding parts which hold the coated electric wires 19 at a predetermined interval. The upper die, whose electric wire holding parts hold the coated electric wires 19, is matched with the lower die so that the coated electric wires 19 between the electric wire holding parts are pressed into the slits 27 of the crimping terminal 13.

When the upper die is matched with the lower die, the coatings 35 of the coated electric wires 19 are cut by the blade parts 29, and the coated electric wires 19 are pushed into the slits 27 at a predetermined depth while the conductors 37 touch the blade parts 29. At the same time, a resin filling space (cavity) which surrounds the crimping blade parts 17 and the coated electric wires 19 around the connecting parts 39 (including the connecting parts 39) is defined inside the lower die and the upper die. When the insulative resin material in a melted state is filled in this resin filling space, the mold housing 21 is molded integrally with the connecting parts 39 and the crimping blade parts 17 and the coated electric wires 19 around the connecting parts 39.

Thereby, it is possible to reduce the component number of the crimping structure 11 and downsize the crimping structure 11. Further, it is possible to perform the crimping operation and to mold the mold housing 21 at the same time. Further, the connecting parts 39 are waterproofed when the insulative resin material is molded integrally.

For the crimping structure 11 of the first embodiment, the crimping blade parts 17 become the protruded pieces 31 which are protruded from the one side part 23 of the base plate 15. Thereby, in comparison with the crimping blade parts whose slits are directly cut at the one side part 23, because the connecting parts 39 are away from the base plate 15, the slits are easy to be surrounded by the insulative resin of the mold housing 21, and it is possible to mold surely.

For the crimping structure 11 of the first embodiment, the coated electric wires 19, which are bent into a mountain-like shape whose top parts 51 correspond to the connecting parts 39 of the conductors 37 and the crimping blade parts 17, are integrally covered by the mold housing 21, which is the insulative resin part, from the top parts 51 until the hem parts 53 at two sides. That is, the coated electric wires 19, which are bent into a mountain-like shape whose top parts 51 correspond to the connecting parts 39, are incorporated inside the mold housing 21. An external force (pulling force) which acts on the two ends of the coated electric wires 19 which are derived from the mold housing 21 is born by the mold housing 21 at the hem parts 53 at two sides which hold electric wire flexed parts 61, and does not act on the connecting parts 39. That is, at two sides of the connecting parts 39 of the conductors 37 and the crimping blade parts 17, strain reliefs 63 are easily constructed. When the coated electric wires 19, which are bent into a mountain-like shape (bent at an acute angle, preferably), are crimped into the slits 27 of the crimping blade parts, pulling loads obliquely downward respectively toward the hem parts 53 at two sides act on the conductors 37 at the connecting parts 39 (with the crimping blade parts 17) which correspond to the top parts 51 of the coated electric wires 19, so that it can be expected that the conductors 37 are prevented from scattering.

In the first embodiment, the coated electric wires 19 are bent into a mountain-like shape whose top parts correspond to the connecting parts 39 and which have the hem parts 53 below, but the coated electric wires 19 also can be bent into a mountain-like shape which have hem parts 53 in positions other than those position toward which the coated electric wires 19 exit from the slits 27.

Furthermore, for the crimping structure 11 of the first embodiment, when the mold housing 21 is molded, the other side part 57 of the crimping terminal 13 can be held in the terminal holding part which is formed in the molding die. Thus, at the time of molding, it is possible to accurately position the crimping terminal 13 with the terminal holding part of the molding die. That is, the terminal clamping space 55 of the mold housing 21 is a space which is formed at a part where the terminal holding part of the molding die is pulled out of the molded article when the molding die is opened after the molding. Thus, the base plate front and back surfaces 59 of the crimping terminal 13 are exposed in the terminal clamping space 55 left in the mold housing 21.

Therefore, it is possible to perform a conduction inspection (inspection on the crimped state) of a predetermined coated electric wire 19 and the crimping terminal 13 with, for example, a probe which is inserted in the terminal clamping space 55, The terminal clamping space 55 may be blocked by waterproof sealant (cap or filler) after the molding.

Figure 4:
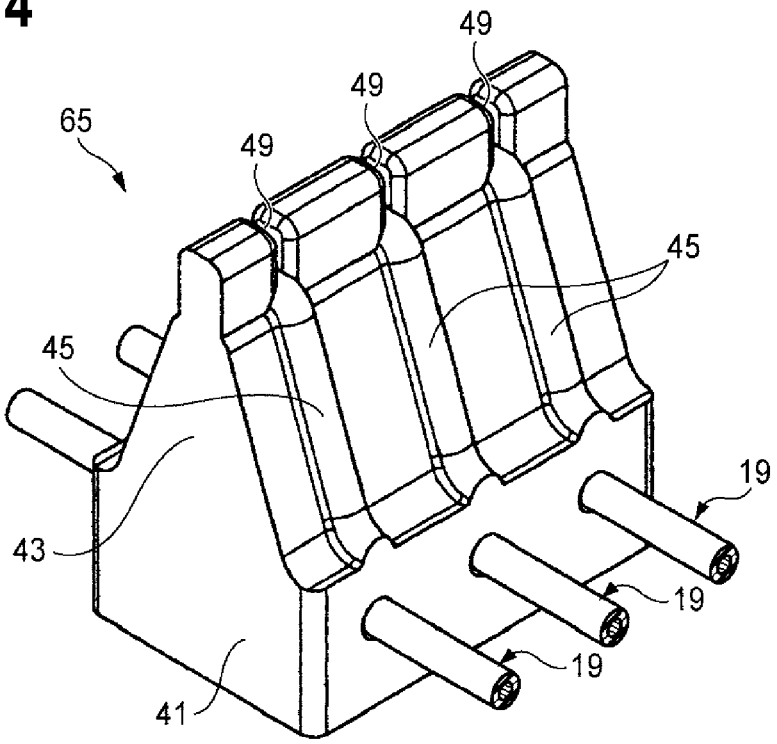
FIG. 4 is an overall perspective view of a crimping structure according to a second embodiment of the present invention.
Figure 5:
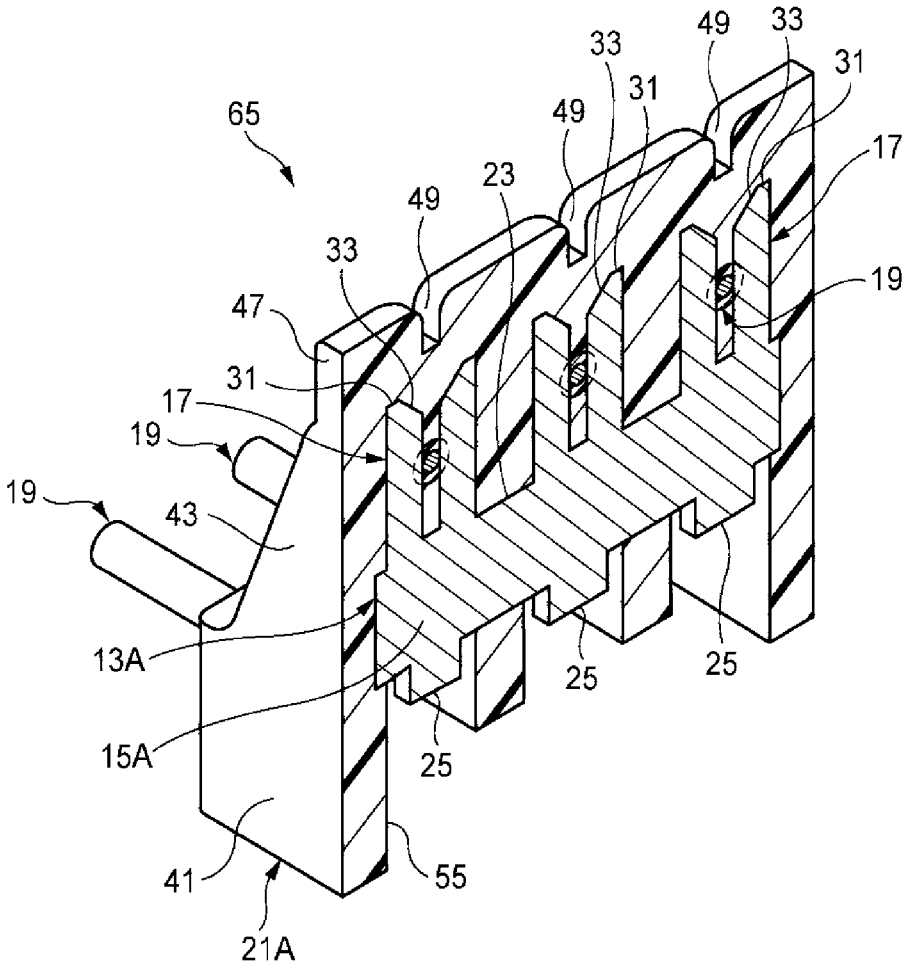
FIG. 5 is a sectional perspective view which shows that the crimping structure shown in FIG. 4 is truncated at a connecting part.

FIGS. 4 and 5 are an overall perspective view and a sectional perspective view of a crimping structure 65 according to the second embodiment of the present invention in which three coated electric wires 19 are conductively connected. Furthermore, the same component members as those of the crimping structure 11 of the above-mentioned first embodiment are given the same numbers, and their detailed description is omitted.

The crimping structure 65 according to the second embodiment is an electric wire joint structure which mainly includes a crimping terminal 13A which has a base plate 15A and crimping blade parts 17, coated electric wires 19, and a mold housing (insulative resin part) 21A.

One side part 23 of the base plate 15A of the crimping terminal 13A is formed with three crimping blade parts 17. Thereby, the three coated electric wires 19, which are crimped to the three crimping blade parts 17, are conductively connected through the base plate 15A.

Thus, the crimping structure according to the present invention can be an electric wire joint structure in which three or more coated electric wires 19 are conductively connected by widening the width of the base plate 15A and increasing the number of the crimping blade parts 17 that are protruded from the one side part 23.

Figure 6:
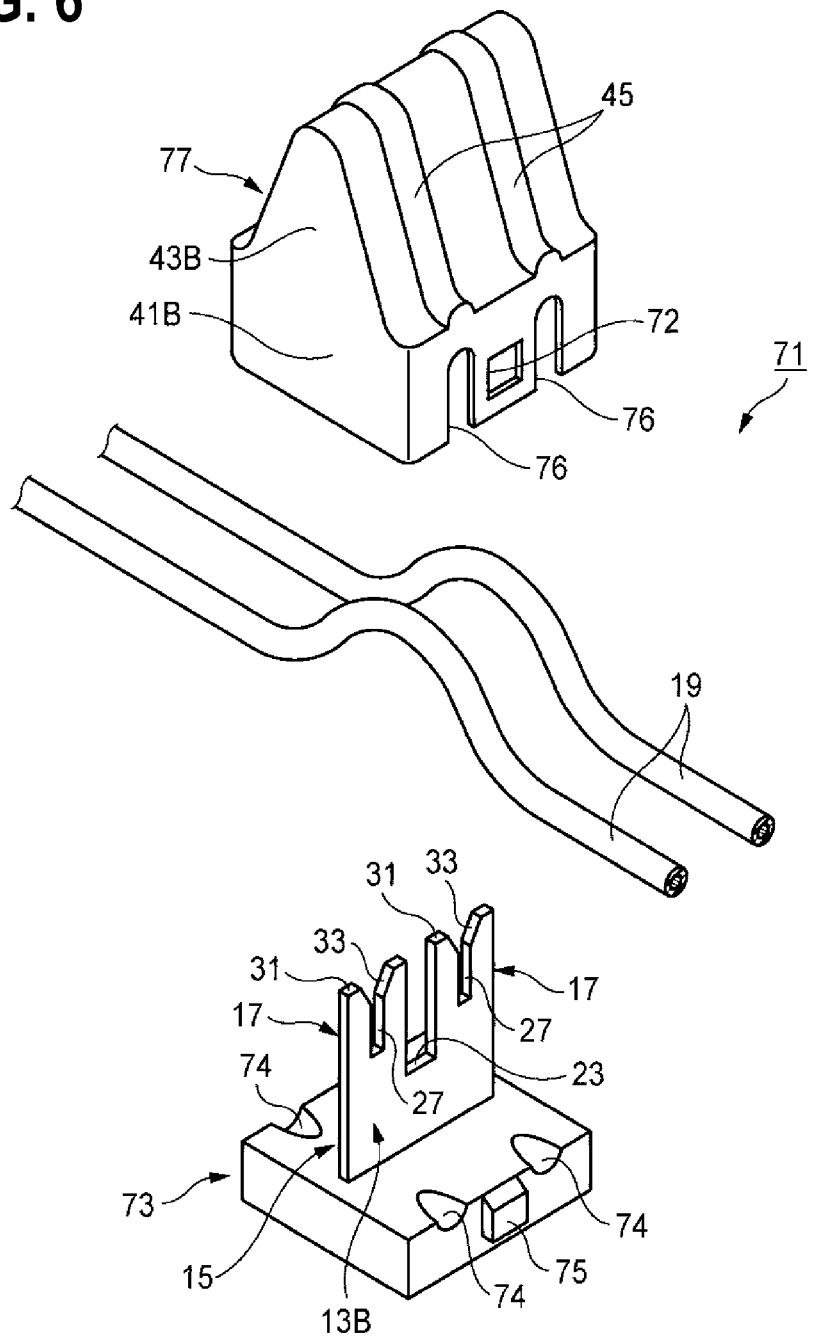
FIG. 6 is an exploded perspective view of a crimping structure according to a third embodiment of the present invention.
Figure 7:
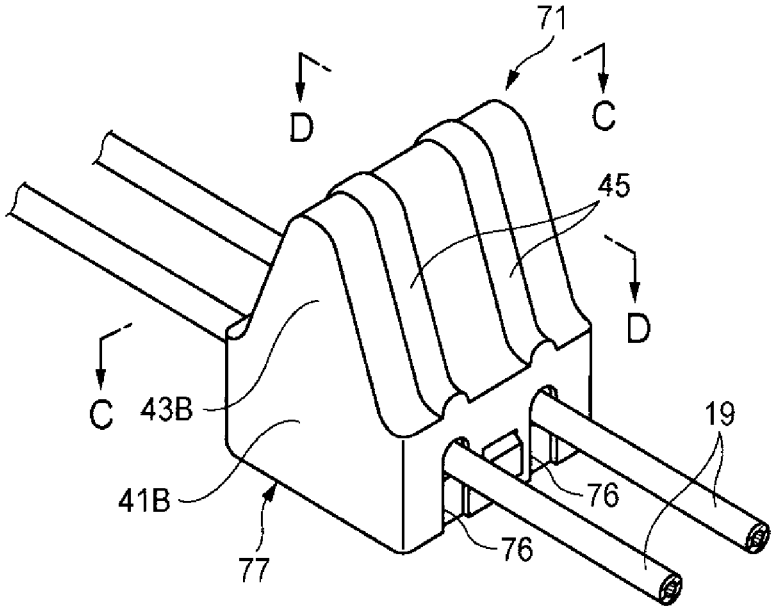
FIG. 7 is an assembling view of the crimping structure shown in FIG. 6.
Figure 8B:
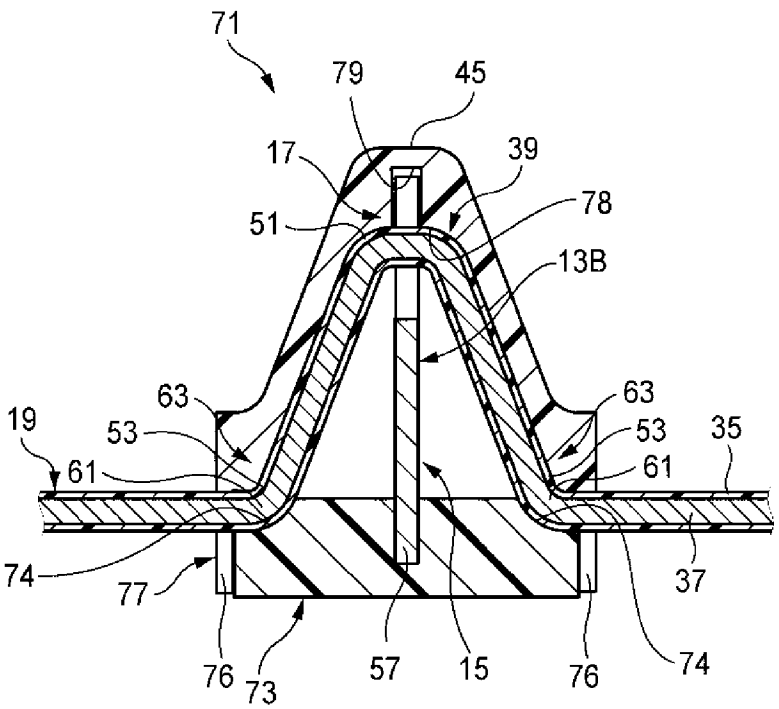
FIG. 8B is a D-D sectional view of FIG. 7.
Figure 8A:
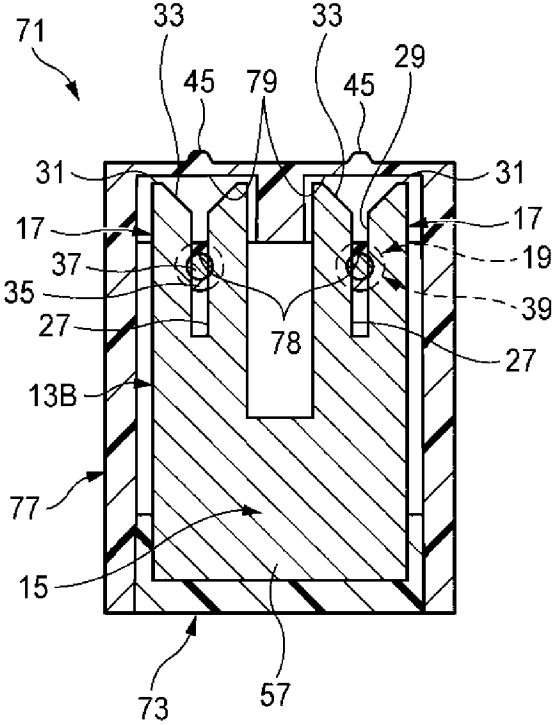
FIG. 8A is a C-C sectional view of FIG. 7.

A crimping structure 71 according to the third embodiment of the present invention is shown in FIGS. 6 to 8. Furthermore, the same component members as those of the crimping structure 11 of the above-mentioned first embodiment are given the same numbers, and their detailed description is omitted.

As shown in FIGS. 6 to 8, the crimping structure 71 according to the third embodiment is an electric wire joint structure which mainly includes a crimping terminal 13B which has a base plate 15 and crimping blade parts 17, coated electric wires 19, and an insulative resin part which includes a terminal stand 73 and a cover 77.

As shown in FIG. 6, the longer upper side of the base plate 15 of the crimping terminal 13B becomes the one side part 23. The longer lower side, which is opposite to the one side part 23, of the base plate 15 is insert-molded in the terminal stand 73. The crimping terminal 13B is installed vertically onto the center of the top surface of the terminal stand 73 which is a flat cuboid-formed block made of insulative resin material. Locking protrusions 75 are protruded from two side surfaces of the terminal stand 73, which are parallel to the crimping terminal 13B, and the top surface corners near the locking protrusions 75 are formed with recesses 74 which correspond to the electric wire flexed part 61 of the coated electric wires 19.

The cover 77 has such an external shape that a roughly triangular prism-formed peak part 43B is formed integrally on a base body 41B which is a flat cuboid-formed block made of insulative resin material, and is a housing whose bottom is opened. As shown in FIG. 8, the upper inside of the cover 77 is concavely provided with a groove 79 where the distal ends of the crimping blade parts 17 are accommodated, and the opening edge of the groove 79 is a pressing part 78 at the time of crimping. The side parts of the base body 41B, which correspond to the locking protrusions 75 of the terminal stand 73, are formed with locking holes 72 which are locked to the locking protrusions 75, and notches 76 to prevent the coated electric wires 19 from interfering with each other.

Thus, according to the crimping structure 71 of the third embodiment, after the two coated electric wires 19 are laid to fit respectively on the slits 27 of the two crimping blade parts 17 of the crimping terminal 13B, the cover 77 is covered from above so that the two coated electric wires 19 are respectively crimped by being pressed to the pressing part 78 of the cover 77 and pushed into the slits 27. Thus, the two coated electric wires 19, which are connected to the base plate 15 through the connecting parts 39, are mutually connected through the base plate 15.

After the locking protrusions 75 of the terminal stand 73 are locked to the locking holes 72 of the cover 77 so that the crimping operation is completed, the coated electric wires 19, which are bent into a mountain-like shape whose top parts 51 correspond to the connecting parts 39 of the conductors 37 and the crimping blade parts 17, are integrally covered by the terminal stand 73 and the cover 77, which are the insulative resin parts, from the top parts 51 until the hem parts 53 at two sides. An external force (pulling force) which acts on the two ends of the coated electric wires 19 which are derived from the notches 76 of the cover 77 is born by clamping parts of the terminal stand 73 and the cover 77 at the hem parts 53 at two sides which hold the electric wire flexed parts 61, and does not act on the connecting parts 39. That is, at two sides of the connecting parts 39 of the conductors 37 and the crimping blade parts 17, strain reliefs 63 can be easily constructed.

Figure 9:
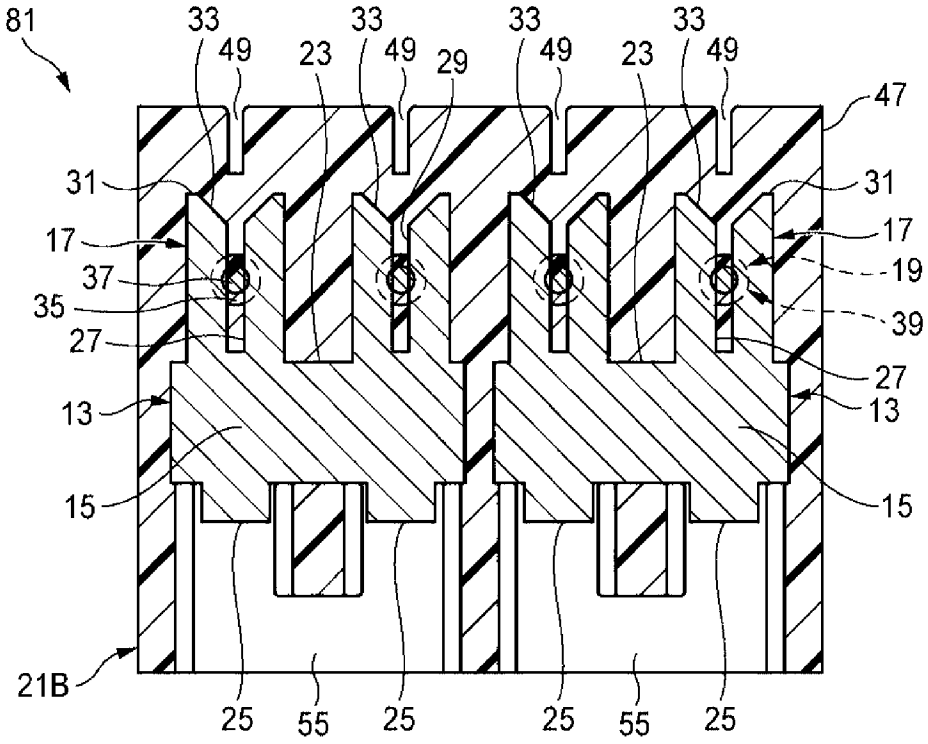
FIG. 9 is a sectional view of a crimping structure according to a fourth embodiment of the present invention.

A crimping structure 81 according to the fourth embodiment of the present invention is shown in FIG. 9. Furthermore, the same component members as those of the crimping structure 11 of the above-mentioned first embodiment are given the same numbers, and their detailed description is omitted. The crimping structure 81 according to the fourth embodiment is an electric wire joint structure which mainly includes two crimping terminals 13, coated electric wires 19, and a mold housing 21B which is an insulative resin part.

Thus, for the crimping structure 81 according to the fourth embodiment, four coated electric wires 19 are crimped respectively by being pushed into slits 27 in two crimping blade parts 17 of the two crimping terminals 13. The two pair of coated electric wires 19, which are respectively connected to base plates 15 through connecting parts 39, are mutually connected respectively through the base plates 15. The connecting parts 39 and the crimping blade parts 17 and the coated electric wires 19 around the connecting parts 39 are fixed by being integrally molded with the mold housing 21B.

Therefore, according to the crimping structure 81 of the fourth embodiment, like the crimping structure 11 in the first embodiment, while strain reliefs 63 are easily constructed at two sides of the connecting parts 39 of the conductors 37 and the crimping blade parts 17, the conductors 37 at the connecting parts 39 are prevented from scattering.

Figure 10:
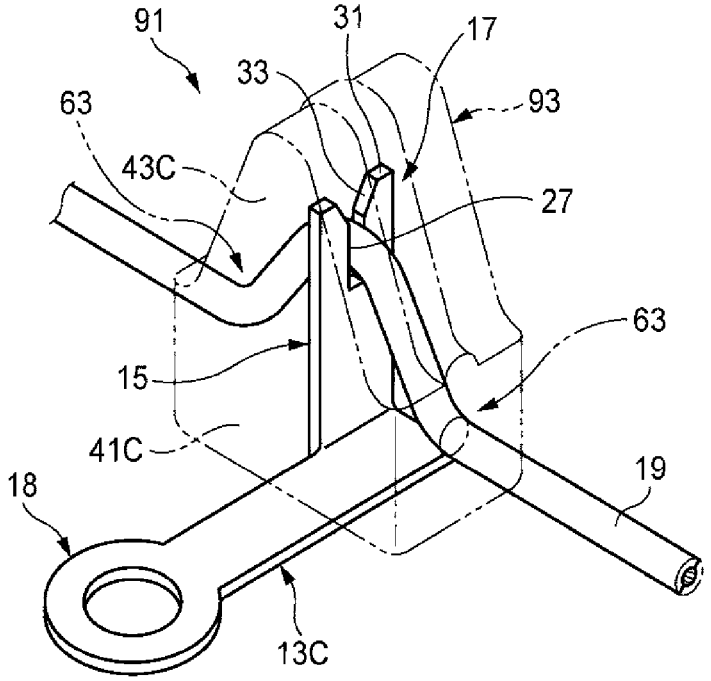
FIG. 10 is a perspective view of a crimping terminal of a crimping structure according to a fifth embodiment of the present invention.
Figure 11A:
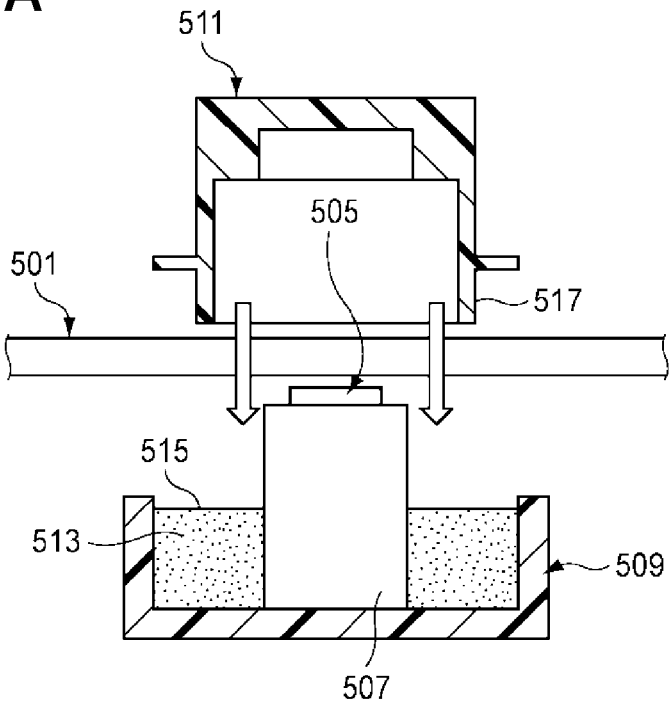
FIG. 11A RELATED ART
FIGS. 11A and 11B are sectional views which describe one example of traditional waterproof crimping connectors.
Figure 11B:
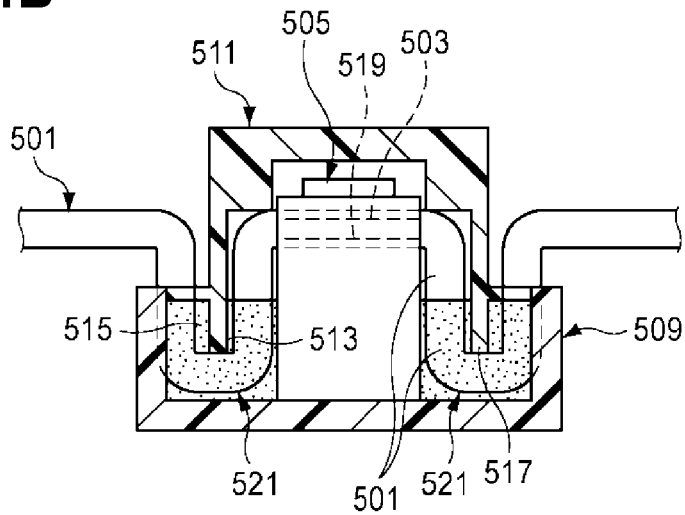

A crimping structure 91 according to the fifth embodiment of the present invention is shown in FIG. 10. Furthermore, the same component members as those of the crimping structure 11 of the above-mentioned first embodiment are given the same numbers, and their detailed description is omitted.

The crimping structure 91 according to the fifth embodiment is a ground connecting structure which mainly includes a crimping terminal 13C, a coated electric wire 19, and a mold housing 93 (shown with imaginary lines) which is an insulative resin part.

The crimping terminal 13C has a flat base plate 15, which is made of conductive metal, a crimping blade part 17 and an LA terminal part 18. The crimping blade part 17 is adjacently provided to the upper side of the base plate 15, and the LA terminal part 18 is adjacently provided to the lower side of the base plate 15.

Thus, for the crimping structure 91 according to the fifth embodiment, one coated electric wire 19 is crimped and connected by being pushed into a slit 27 in the crimping blade part 17 of the crimping terminal 13C. The connecting part 39 and the crimping blade part 17 and the coated electric wire 19 around the connecting part 39 are fixed by being integrally molded with the mold housing 93. Thus, when the LA terminal part 18 is fixed with a bolt to a vehicle body panel or the like, the coated electric wire 19, which is connected to the base plate 15 of the crimping terminal 13C through the connecting part 39, is grounded and connected to the vehicle body panel or the like through the LA terminal part 18.

Therefore, according to the crimping structure 91 of the fifth embodiment, like the crimping structure 11 in the first embodiment, while strain reliefs 63 are easily constructed at two sides of the connecting part 39 of the conductor 37 and the crimping blade part 17, the conductor 37 at the connecting part 39 is prevented from scattering.

Thus, the crimping structure according to the present invention can be applied to various kinds of crimping structures which use crimping terminals having crimping blade parts like the above-mentioned electric wire joint structure or ground connecting structure.

Here, the features of the crimping structure according to the embodiments of the present invention described above are briefly, collectively listed as follows, respectively.

[1] A crimping structure 11 which includes a crimping terminal 13 that has a base plate 15 and a crimping blade part 17 on the base plate 15, a coated electric wire 19 that has a conductor 37 which is electrically connected to the crimping blade part 17 by crimping the coated electric wire 19 to the crimping blade part 17, and is bend to be formed into a mountain-like shape whose top part 51 is a connecting part 39 where the conductor 37 and the crimping blade part 17 are connected, and an insulative resin part (mold housing) 21 that covers a part of the coated electric wire 19 from the top part 51 to hem parts 53 at two sides of the mountain-like shape.

[2] The crimping structure 11 of the above [1], wherein the insulative resin part (mold housing) 21 is integrally molded.

[3] The crimping structure 11 of the above [2], wherein the crimping blade part 17 is a protruded piece 31 which is protruded from one side part 23 of the base plate 15.

Therefore, according to the crimping structures 11, 65, 71, 81 and 91 of the above embodiments, the strain reliefs 63 can be constructed with a simple structure. The present invention is not limited to the above-described embodiments, and suitable modifications, improvements and the like can be made. Moreover, the materials, shapes, dimensions, numbers, installation places, and the like of the components in the above embodiment are arbitrarily set as far as the invention can be attained, and not particularly restricted.

What is claimed is:

1. A crimping structure comprising:

a crimping terminal that has a base plate and a crimping blade part on the base plate;

a coated electric wire that has a conductor which is electrically connected to the crimping blade part by crimping the coated electric wire to the crimping blade part, and is bent to be formed into a mountain-like shape whose apex is a connecting part where the conductor and the crimping blade part are connected; and an insulative resin part that covers a part of the coated electric wire from the apex to hem parts at two sides of the mountain-like shape and the crimping blade part.

2. The crimping structure according to claim 1, wherein the insulative resin part is integrally molded.

3. The crimping structure according to claim 2, wherein the crimping blade part is a protruded piece protruded from one side part of the base plate.

4. A crimping structure comprising:

a crimping terminal comprising a base plate and a crimping blade part disposed on the base plate; and an insulating resin part, wherein, when a coated electric wire is crimped by the crimping blade part, the crimping blade part electrically connects to the coated electrical wire by crimping the coated electric wire, the coated electrical wire is bent to form into a mountain-like shape within the insulating resin part, and the crimping blade part is connected to an apex of the mountain-like shape of the coated electric wire, and wherein the insulating resin part is configured to cover a part of the coated electric wire from the apex to bases of the mountain-like shape of the coated electrical wire formed within the insulating resin part.

5. The crimping structure according to claim 4, wherein the mountain-like shape is formed the mountain-like shape of the coated electrical wire comprises two slanted sides meeting at the apex.

6. The crimping structure according to claim 4, wherein the mountain-like shape is formed by bending the coated electrical wire, the apex being disposed at the bend of the coated electrical wire.

7. The crimping structure according to claim 6, the coated electrical wire is bent at an acute angle.

8. The crimping structure according to claim 4, wherein the crimping terminal comprises a single crimping blade part.

9. The crimping structure according to claim 4, wherein the crimping terminal comprises a plurality of crimping blade parts configured to individually crimp respective coated electrical wires of a plurality of electrical wires.

10. The crimping structure according to claim 4, wherein the crimping terminal further comprises a ring-type terminal electrically connected to the crimping blade part, the ring-type terminal being configured to protrude from the insulating resin part when the coated electric wire is crimped by the crimping blade part.

11. The crimping structure according to claim 4, wherein the crimping terminal further comprises an LA terminal electrically connected to the crimping blade part, the LA terminal being configured to protrude from the insulating resin part when the coated electric wire is crimped by the crimping blade part.

12. The crimping structure according to claim 4, wherein the insulating resin part is configured to receive the coated electrical wire before the coated electrical wire is crimped by the blade part.

13. The crimping structure according to claim 4, wherein the insulating resin part is formed separately from the crimping terminal.

14. The crimping structure according to claim 4, wherein the insulating resin part comprises a rib disposed on an outside of the insulating resin corresponding to a position of the coated electrical wire within the insulating resin when the coated electric wire is disposed in the insulating resin.

15. A crimping structure comprising:

a crimping terminal comprising a base plate and a crimping blade part disposed on the base plate; and an insulating resin part, wherein, when a coated electric wire is crimped by the crimping blade part, the crimping blade part electrically connects to the coated electrical wire by crimping the coated electric wire, the coated electrical wire is bent to form into a substantially triangular shape within the insulating resin part, and the crimping blade part is connected to an apex of the substantially triangular shape of the coated electric wire, and wherein the insulating resin part is configured to cover a part of the coated electric wire from the apex to bases of the substantially triangular shape of the coated electrical wire formed within the insulating resin part.

16. The crimping structure according to claim 15, wherein the insulating resin part is shaped substantially like a triangular prism.

* * * * *